US007736729B2

(12) United States Patent
Chang et al.

(10) Patent No.: US 7,736,729 B2
(45) Date of Patent: Jun. 15, 2010

(54) BLAST ENERGY MITIGATING COMPOSITE

(75) Inventors: Susan C. Chang, Canonsburg, PA (US); Douglas J. Merriman, Wheeling, WV (US)

(73) Assignee: Touchstone Research Laboratory, Ltd, Triadelphia, WV (US)

( * ) Notice: Subject to any disclaimer, the term of this patent is extended or adjusted under 35 U.S.C. 154(b) by 0 days.

(21) Appl. No.: 11/165,580

(22) Filed: Aug. 12, 2005

(65) Prior Publication Data

US 2007/0036966 A1 Feb. 15, 2007

(51) Int. Cl.
*B32B 3/26* (2006.01)
*B32B 3/00* (2006.01)
*B32B 9/00* (2006.01)

(52) U.S. Cl. ..... 428/304.4; 428/316.6; 428/318.4

(58) Field of Classification Search ..... 428/304.4, 428/316.8, 318.4

See application file for complete search history.

(56) References Cited

U.S. PATENT DOCUMENTS 5,888,469 A * 3/1999 Stiller et al. ..... 423/445 R
6,112,931 A * 9/2000 Booth et al. ..... 220/88.1
2004/0107827 A1* 6/2004 Edberg et al. ..... 89/36.04

OTHER PUBLICATIONS

High Strength Glass Fibers, agy, Technical Paper.

* cited by examiner

*Primary Examiner*—Victor S Chang
(74) *Attorney, Agent, or Firm*—Philip D. Lane

(57) ABSTRACT

A blast energy mitigating composite useful for protecting a surface or an object from a blast, shock waves, or stress waves caused by a sudden, violent release of energy is described. Certain configurations of the blast energy mitigating composite may include a energy mitigating units contained in an energy mitigating matrix. The energy mitigating units may comprise a porous energy mitigating material such as carbon foam.

19 Claims, 5 Drawing Sheets

BLAST ENERGY MITIGATING COMPOSITE

This invention was made with Government support under contract number W9113M-04-C-0109 awarded by the U.S. Army Space and Missile Defense Command. The Government has certain rights in the invention.

DETAILED DESCRIPTION OF CERTAIN EMBODIMENTS OF THE INVENTION

A blast energy mitigating composite useful for protecting a surface or an object from a blast, shock waves, or stress waves caused by a sudden, violent release of energy is described. Certain configurations of the blast energy mitigating composite may also be useful for reducing the possibility of a sympathetic detonation. As used in herein, "mitigate" and other variants of the word "mitigate" refer to the reduction of blast wave energy through any mechanism in which the blast wave energy is lessened or reduced, including but not limited to, energy absorption, attenuation, diffusion, dissipation, or the like.

Figure 1:
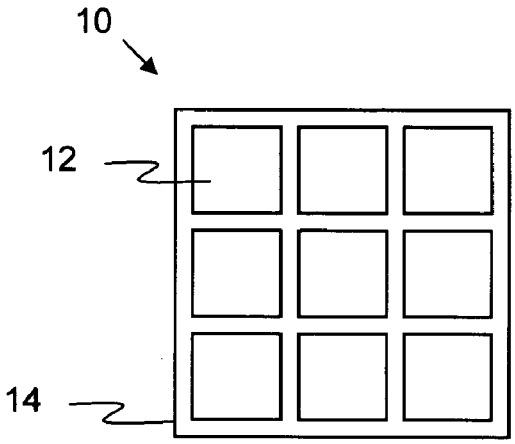
FIG. 1 is a diagrammatic view of an embodiment of a blast energy mitigating composite.
Figure 2:
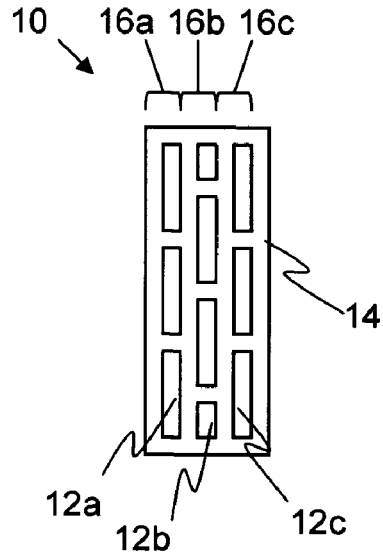
FIG. 2 is a cross-sectional view of the blast energy mitigating composite of FIG. 1.
Figure 3:
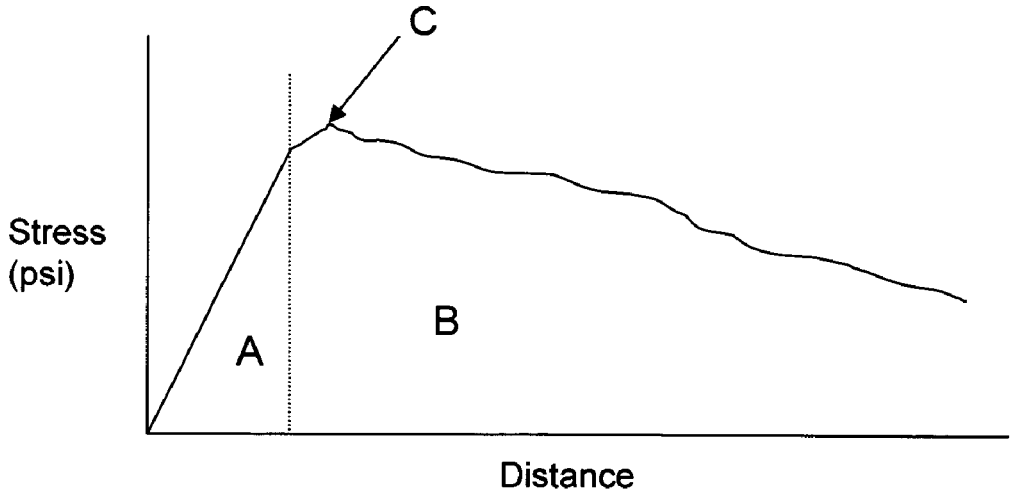
FIG. 3 is a stress-strain plot showing the results of a compressive strength test for an embodiment of an energy mitigating material.

With reference to FIG. 1, there is shown an embodiment of a blast energy mitigating composite in the form of a panel 10. As discussed in more detail below, the shape of the blast energy mitigating composite is not limited to a panel and can be configured into a wide variety of shapes and configurations. For aid in introducing certain concepts of the blast energy mitigating composite, FIGS. 1, 2, and 3 illustrate the blast energy mitigating composite as an approximately square panel. The panel 10 comprises an energy mitigating material which may be provided as any number of predetermined geometric shapes, each geometric shape providing an energy mitigating unit 12. In FIG. 1, the geometric shape of the energy mitigating unit 12 is illustrated as a rectangular block. An energy mitigating matrix 14 surrounds, or otherwise encapsulates, the energy mitigating units 12.

In FIG. 2, a cross-sectional diagrammatic view of the panel 10 of FIG. 1 is illustrated. As shown in FIG. 2, the energy mitigating units 12*a*, 12*b*, and 12*c* may be arranged in one or more layers, such as shown by layers 16*a*, 16*b*, and 16*c* in the panel 10.

The energy mitigating material, comprising the energy mitigating units 12, is able to mitigate a significant amount of the energy generated from a blast by consuming the blast energy as work to the energy mitigating composite. Such consumption may be accomplished by changing the physical structure of the energy mitigating unit. For example and without intending to be bound by theory, the blast energy may be mitigated by a mechanism in which the energy mitigating unit is progressively crushed as the blast energy is absorbed or dissipated.

The progressive crushing of the energy mitigating units may be realized by selecting an energy mitigating material that is porous and exhibits relatively uniform pore sizes. In some embodiments, the pore sizes may have values ranging from about 50 μm to about 2 mm.

Another consideration for the energy mitigating material is the ability of the energy mitigating material to absorb energy. With reference to FIG. 3, there is shown a stress-strain profile resulting from a non-confined compressive strength test for one embodiment of an energy mitigating material. The non-confined compressive strength test measures the amount of compressive load a sample can bear prior to failure, during failure, and after the material begins to fail. Referring to FIG. 3, as the compressive load is applied to the energy mitigating material, the energy mitigating material produces a stress-strain region A, herein referred to as an "initial energy mitigation region." The initial energy mitigation region A represents the amount of compressive load received by the energy mitigating material before the material begins to fail. In some, but not all embodiments, the initial energy mitigation region A will be bound by a linear or relatively linear stress-strain curve. The initial energy mitigation region A represents the amount of energy the energy mitigating material was able to absorb before the material begins to fail. Once the energy mitigating material begins to fail, a second region B, herein referred to as a "secondary energy mitigation region," is produced. The secondary energy mitigation region B is bound by a stress-strain curve that generally reflects progressively decreasing applied load values. The secondary energy mitigation region B represents the amount of energy the energy mitigating material is able to absorb as the physical structure of energy mitigating material fails. The energy mitigating material is a material that is able to absorb energy beyond the initial energy mitigation region. In certain embodiments, the energy mitigating material is able to absorb at least as much energy in the secondary energy mitigation region as was absorbed in the initial energy mitigation region. In other embodiments, the energy mitigating material may absorb about 150% to about 300% more energy in the secondary energy mitigation region than in the initial energy mitigation region.

Depending on the amount of energy to be mitigated, the compressive strength of the energy mitigating material is a factor that should be considered. At some point in the secondary energy mitigation region, the material will exhibit a maximum compressive strength value C which represents the compressive strength of the energy mitigating material. In some embodiments, the non-confined compressive strength of the energy mitigating material may have a value ranging from about 300 p.s.i. to about 18,000 p.s.i.

The energy mitigating material may be a porous material having substantially uniform pore sizes and a relatively uniform distribution of pores. In some embodiments, the energy mitigating material may be a foam material. In certain embodiments, the foam may be a carbon foam or polymer foam. Carbon foams produced from polymers, resins, coal, coal tar pitch, coal extracts, refined pitches, petroleum pitch, or other similar materials may be suitable energy mitigating materials. Some embodiments of the energy mitigating material may have a carbon content above about 50% by weight. Further, the energy mitigating material may have a carbon content ranging from about 75% to about 100% by weight. In some embodiments, the energy mitigating material may comprise a carbon foam, having a density a value ranging from about 0.1 to about 1.0 g/cc. Other embodiments may include an energy mitigating material comprising a porous carbon, a porous graphite, or carbon foam, and the like having a density value greater than about 1.0 g/cc.

Figure 4:
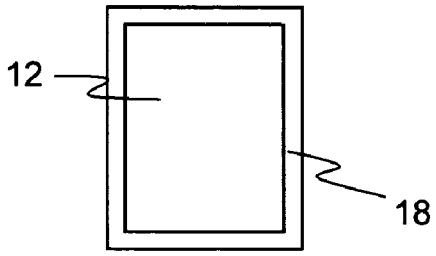
FIG. 4 is a diagrammatic view of an embodiment of an energy mitigating unit.

The energy mitigating units may further comprise reinforcements or additives in addition to the energy mitigating material. For example, as shown in FIG. 4, the energy mitigating units may have one or more surfaces coated with one or more layers of a surface coating 18. The surface coating 18 may include polymers or resins different from that used in the energy mitigating matrix which will be described below. For example, one or more surfaces of the energy mitigating units may be coated with one or more of metals, ceramics, glass, pyrolytic carbon, poly-urethane, semi-rigid polyurethane, polypropylene, resins, silicone, nylon, latex, rubber, other similar elastomeric materials, epoxy, acrylics, polycarbonates, phenolic resins, furfural resins, or other similar polymeric materials. Additionally, the surface coatings may be or include a layer of textile materials such as, but not limited to, carbon fibers, Kevlar, aramid, synthetic wires, metal wires. Further, the energy mitigating material may incorporate additives such as, but not limited to, particulates or fibers, to enhance the energy mitigating capabilities of the energy mitigating material.

The shape of the energy mitigating units is not particularly limited and may include a wide range of shapes. In FIG. 1, the energy mitigating units have a cross-sectional shape that is approximately square. Other cross-sectional shapes include, but are not limited to triangular, circular, oval, cross-shaped, rectangular, pentagonal, hexagonal, heptagonal, octagonal, and other regular or irregular polygonal cross-sectional shapes. The energy mitigating units may also take the shape of more complex three dimensional shapes, including but not limited to, spherical, hemi-spherical, cubical, pyramidal, tetrahedral, octahedral, icosohedral, cylindrical, semi-cylindrical, combinations thereof, and other three dimensional geometric shapes.

The size of the energy mitigating units may vary widely. The energy mitigating units are sized such that when they are used in the composite, the energy mitigating units are able to mitigate portions of the blast energy. While the size is not particularly limited and can vary depending upon the type and amount of energy to be mitigated, the largest dimension of the energy mitigating unit may range from about ¼ of an inch to about 2 inches. Some embodiments utilize energy mitigating units having a largest dimension of about 1 inch.

With continuing reference to FIG. 1, the energy mitigating units 12 are positioned in an energy mitigating matrix 14. The energy mitigating units 12 may be individually separated by the energy mitigating matrix 14. In some embodiments, the energy mitigating units are fully or partially confined by at least a portion of the energy mitigating matrix 14. By fully or partially confining the energy mitigating units 12 with the energy mitigating matrix 14, the capacity of the energy mitigating units 12 to mitigate the blast energy increases relative to a non-confined energy mitigating unit.

The energy mitigating matrix 14 mitigates a portion of the blast energy that has not been absorbed or dissipated by the energy mitigating units 12, as well as to reflect a portion of the blast stress waves to the energy mitigating units 12 for additional energy mitigation. The energy mitigating units 12 and the energy mitigating matrix 14 work together in the blast energy mitigating composite to mitigate blast energy interacting with the composite. In certain embodiments, the energy mitigating matrix 14 may diffuse and distribute energy through portions of the composite. In some embodiments, the energy mitigating matrix 14 holds the energy mitigating units 12 in a fixed relationship to one another.

The matrix material should be in communication with the energy mitigating units such that energy may be transferred between the energy mitigating matrix and the energy mitigating units. In some embodiments, the energy mitigating matrix is in direct physical contact with the energy mitigating units. In certain embodiments, the energy mitigating units are equally spaced apart throughout the blast energy mitigating composite.

The energy mitigating matrix 14 is made from a polymeric matrix material that has a different blast wave impedance value than that for the energy mitigating material. In some embodiments the matrix material is able to distribute and diffuse the blast energy interacting with the composite. In certain other embodiments, the matrix material is capable of physically bonding to the energy mitigating units. A wide variety of polymer and elastomeric materials may be used as the matrix material. In some embodiments, the matrix material may include a material that can flex significantly and still largely return to its originally formed shape. A wide variety of polymers, elastomers, and resins that exhibit an elongation greater than about 100% (ASTM D638) may be used as matrix materials. For some embodiments, suitable matrix materials, may include but are not limited to, poly-urethane, semi-rigid polyurethane, polyethylene, polypropylene, resins, silicone, nylon, latex, rubber, or other similar elastomeric materials. Other embodiments may include more rigid matrix materials. For example, other embodiments of the matrix material may include, but are not limited to, epoxy, acrylics, polycarbonates, phenolic resins, or furfural resins as the matrix material.

The energy mitigating matrix may further comprise reinforcements or additives in addition to the matrix material. For example, some embodiments may include matrix additives such as, but not limited to, fire retardants or heat reducing agents incorporated within the matrix material forming the energy mitigating matrix. The blast energy mitigating composite may be formed in a wide variety configurations. With reference to FIGS. 1 and 2, the blast energy mitigating composite has at least one layer 16*a*, 16*b*, or 16*c* of energy mitigating units 12 in an energy mitigating matrix 14. The number of energy mitigating units in the layer 16*a*, 16*b*, or 16*c* is not limited and may largely be controlled by the size of the panel 10 and the size and shape of the energy mitigating units 12. While trying to maximize the number of energy mitigating units in one of the layers 16*a*, 16*b*, or 16*c*, in certain embodiments there may be a portion of the energy mitigating matrix 14 between the energy mitigating units 12. In some embodiments, the distance between the energy mitigating units may have a value ranging from about 1/16 of an inch to about ⅜ of an inch. In some embodiments, the energy mitigating units are relatively equidistant from one another and provide a relatively equal amount of energy mitigating matrix material between each energy mitigating unit.

As shown in FIG. 2, in certain embodiment of the blast energy mitigating composite, the position of the energy mitigating units in the second layer 16*b* may be staggered relative to the position of the energy mitigating units in the first layer 16*a*. Similarly, the position of the energy mitigating units in the third layer 16*c* may be staggered relative to the position of the energy mitigating units in the second layer 16*b*. In certain embodiments, the position of the energy mitigating units in each layer is staggered relative to the energy mitigating units in adjacent layers. The energy mitigating matrix 14 may be positioned between each layer of energy mitigating units. The spacing between layers may vary widely based on such factors as the amount of blast energy to be mitigated, the size and shape of the energy mitigating units, the type of energy mitigating material, and the type of energy mitigating matrix. In certain embodiments the spacing between layers may range from a value of 1/16 of an inch to about 3/8 of an inch. In some embodiments, the distance between the energy mitigating units in all directions in the composite are about equal. While the layers depicted in FIG. 2 are relatively linear, the layers are not restricted to such a configuration. For example, the energy mitigating units may be configured in a close-packed or staggered arrangement in all directions through the energy mitigating matrix. For some embodiments, given any configuration for the plurality of energy mitigating units throughout the composite, a portion of the energy mitigating matrix may be positioned between the layers or energy mitigating units. The number of layers in the blast energy mitigating composite is not limited and may vary depending upon such factors as the amount of blast energy to be absorbed, the structure to be protected, the energy mitigating material, the size of the energy mitigating units, and the matrix material. In some embodiments, the number of layers is at least about 2. In other embodiments, the number of layers may range from about 1 to about 20 or more.

Further, in some embodiments, the blast energy mitigating composite may included different energy mitigating units within a layer or between layers. The energy mitigating units may differ based on size, shape, composition of the energy mitigating material, or based on properties of the energy mitigating material such as, pore sizes, density, compressive strength, or other properties. By using different energy mitigating units, a blast energy mitigating composite may be tailored for specific blast mitigation situations or applications. For example, a blast energy mitigating composite may have a first layer of energy mitigating units that are made from a material that is less dense than energy mitigating units in adjacent layers, thus producing a graded blast energy mitigating composite. Additionally, the composition of the energy mitigating matrix may vary in the blast energy mitigating composite. For example different matrix materials may be used in different regions of the blast energy mitigating composite. In this way the blast energy mitigating composite may be tailored or customized for different blast mitigation situations or applications. For example, different matrix materials may be used around different blast mitigating units either within a given layer, or between layers.

Figure 5:
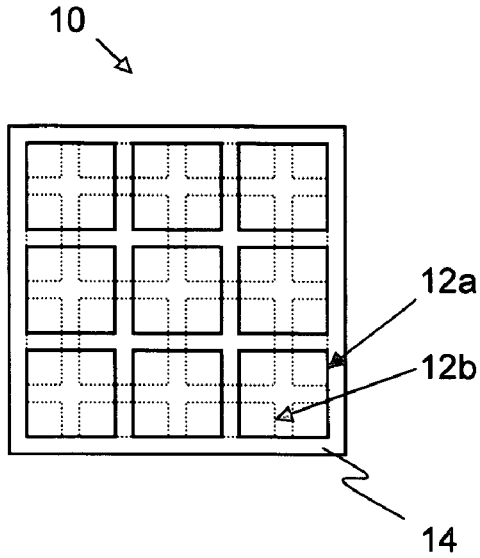
FIG. 5 is another diagrammatic view of the blast energy mitigating composite of FIG. 1.

With reference to FIG. 5, the panel 10 of FIG. 1 is illustrated showing the energy mitigating units 12*b* in the second layer 16*b* as dotted lines, relative to the position of the energy mitigating units 12*a* in the first layer 16*a*. The energy mitigating units 12*a* and 12*b* are staggered with respect to one another such that energy mitigating units in adjacent layers are not positioned directly behind one another.

Figure 6:
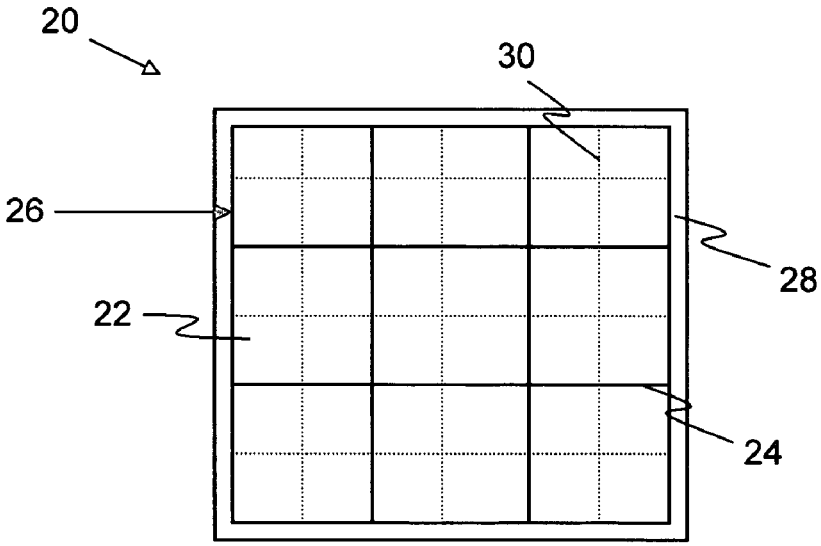
FIG. 6 is a diagrammatic view of another embodiment of a blast energy mitigating composite.
Figure 7:
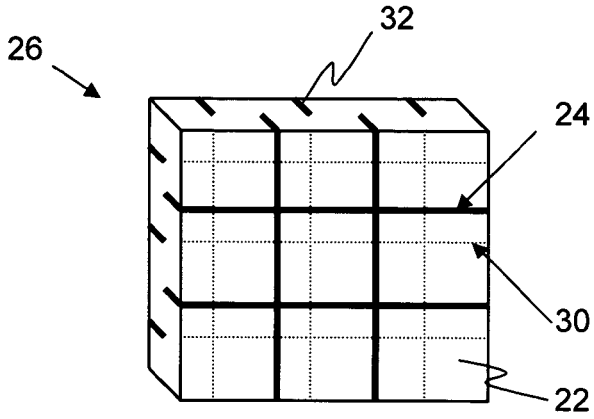
FIG. 7 is a diagrammatic view of an embodiment of a panel of energy mitigating material grooved so as to provide energy mitigating units.

FIGS. 6 and 7 illustrate another embodiment of a blast energy mitigating composite in the form of a panel 20. The panel 20 includes energy mitigating units 22 formed from a panel of energy mitigating material that has a plurality or series of grooves 24 positioned in the energy mitigating material to form a grooved panel 26 and effectively create a plurality of energy mitigating units 22 where the panel of energy mitigating material is surrounded by the energy mitigating matrix 28. Further, other embodiments may include a similar set of grooves 30 in an opposing sides of the material and are illustrated with dotted lines. The grooves 30 serve to form another set of energy mitigating units 32 on the opposing side of the energy mitigating material. In certain embodiments, the grooves are positioned such that, as discussed above, the energy mitigating units on each side of the material are not positioned directly behind one another. The grooves may be wide enough to allow portions of the matrix material to enter and fill the groove during assembly. In some embodiments, the width of the groove may range from about 1/16 of an inch to about 3/8 of an inch. In certain configurations, the depth of the groove may extend from about 1/4 to about 3/4 of the thickness of the panel. Some embodiments utilize a groove that extends about half way through the panel. While FIG. 4 illustrates grooves that form energy mitigating units with a square cross-sectional shape, virtually any configuration of grooves forming any variety of geometric shapes discussed above, may be utilitized. The energy mitigating matrix may be any of the matrix materials discussed above.

Figure 8:
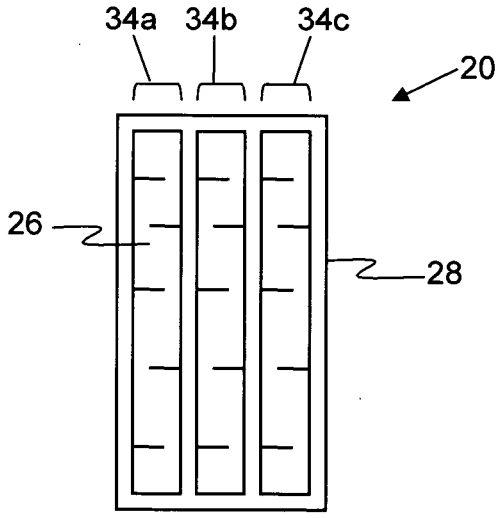
FIG. 8 is a cross-sectional view of the blast energy mitigating composite of FIG. 6.

Turning to FIG. 8, a blast energy mitigating composite in the form of a panel 20 utilizing grooved panels 26 as energy mitigating units may be configured such that one or more layers 34*a*, 34*b*, and 34*c* of grooved panels are positioned in an energy mitigating matrix 28. In some embodiments, the grooves are large enough that the grooves are filled with the energy mitigatine matrix 28. Where more than one layer 34 is used in the panel 26, a portion of the energy mitigating matrix 28 may be located between each layer as discussed above.

While the above descriptions have illustrated a blast energy mitigating composite having a relatively square cross-sectional shape, the shape of the composite is not limited and can take any variety of shapes. Some shapes may include other cross-sectional shapes, including but not limited to, triangular, circular, oval, square, rectangular, pentagonal, hexagonal, heptagonal, octagonal, and other regular and irregular polygonal cross-sectional shapes. The blast energy mitigating composite may also take the shape of more complex three dimensional shapes, including but not limited to, spherical, cubical, tetrahedral, octahedral, icosahedral, cylindrical, and other three dimensional geometric shapes.

Figure 9:
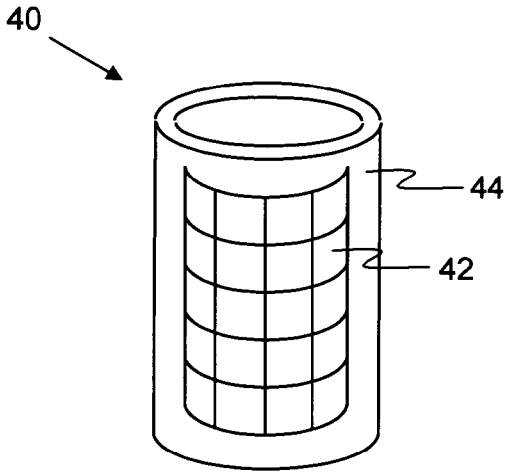
FIG. 9 is a diagrammatic view of yet another embodiment of a blast energy mitigating composite in the shape of a cylinder.
Figure 10:
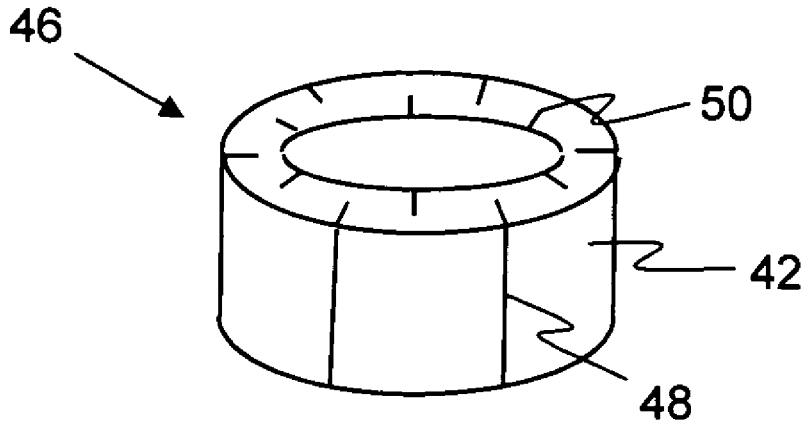
FIG. 10 is a diagrammatic view of an embodiment of a ring of energy mitigating material formed to provide energy mitigating units.
Figure 11:
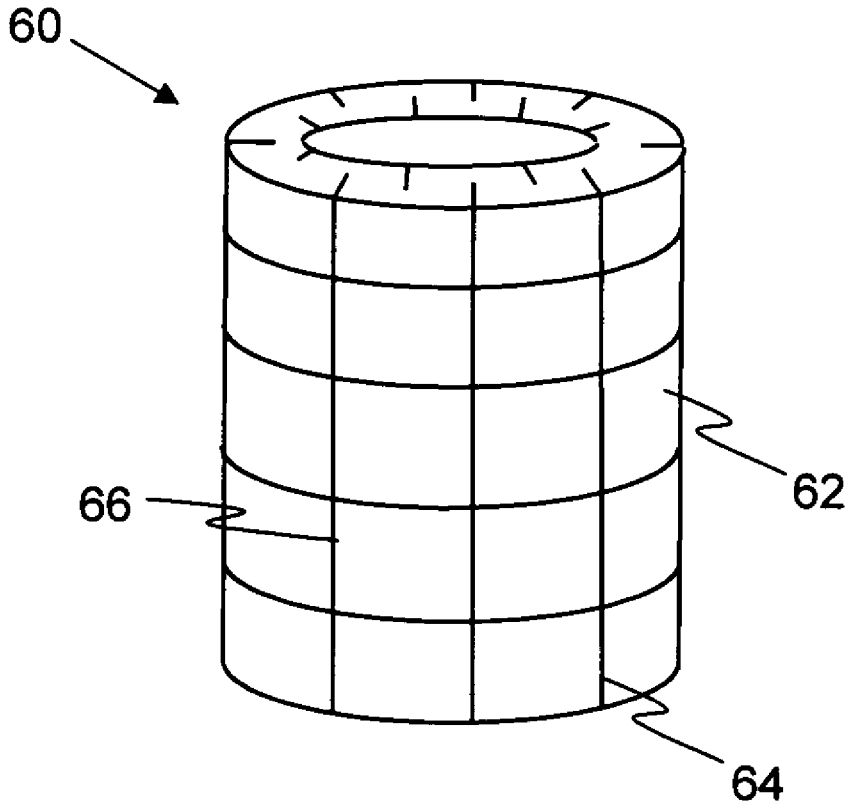
FIG. 11 is a diagrammatic view of an embodiment of a tube of energy mitigating material formed to provide energy mitigating units.

FIG. 9 illustrates an embodiment of a blast energy mitigating composite in the form of a cylinder 40. The cylinder 40 includes energy mitigating units 42 surrounded by or otherwise encompassed by an energy mitigating matrix 44. The energy mitigating units may be constructed from any of the energy mitigating materials discussed above. Further, the energy mitigating matrix may comprise the matrix materials discussed above. Turning to FIG. 10, energy mitigating units 42 used for the embodiment of the cylinder 40 are illustrated. The energy mitigating units may be prepared by forming rings 46 of the energy mitigating material and forming vertical grooves 48 on the outside surface of the rings to form a plurality of energy mitigating units. In other embodiments inside grooves 50 may be formed on the inside surface of the ring to form an additional series of energy mitigating units in staggered relationship to the energy mitigating units on the outside of the rings. A plurality of energy mitigating rings may be placed in stacking relationship to one another to the desired height of the cylinder. In some embodiments the energy mitigating matrix encapsulates each ring such that there is at least a portion of the matrix material between each ring. Referring to FIG. 11, in another embodiment, the energy mitigating material is formed into a shape of the cylinder 60 and energy mitigating units 62 are provided by forming vertical grooves 64 and horizontal grooves 66 on the outside surface of the cylinder. Further, vertical and horizontal grooves may be formed on the inside surface of the cylinder. The cylinder is encapsulated in an energy mitigating matrix to form an embodiment of a blast energy mitigating composite in the form of a cylinder. As discussed above with respect to the panel type configuration, the cylinder may include more than one layer of energy mitigating units.

While relatively linear blast energy mitigating composites and cylindrical energy mitigating composites have been illustrated, virtually any configuration and shape of the blast energy mitigating composite is possible.

The amount of blast energy mitigated is dependent on the design of the blast energy mitigating composite, the properties of the energy mitigating material, the properties of the energy mitigating matrix, and the magnitude of the blast energy interacting with the blast energy mitigating composite. In some embodiments, the blast energy mitigating composite may mitigate at least half the energy interacting with the blast energy mitigating composite. In certain other embodiments, the blast energy mitigating composite may mitigate at least 70% of the explosive energy interacting with the blast energy mitigating composite. In other embodiments, the composite may mitigate from about 60 to about 90% or more of the blast energy interacting with the blast energy mitigating composite.

Figure 12:
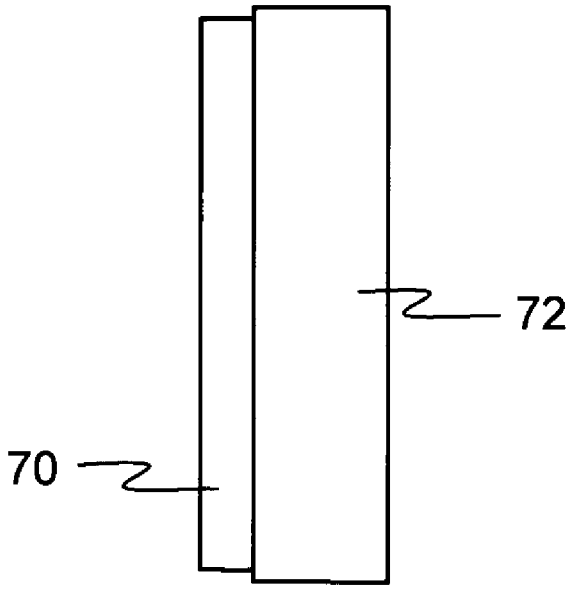
FIG. 12 is a cross-sectional diagrammatic view of an embodiment of a blast energy mitigating composite on a surface to be protected.
Figure 13:
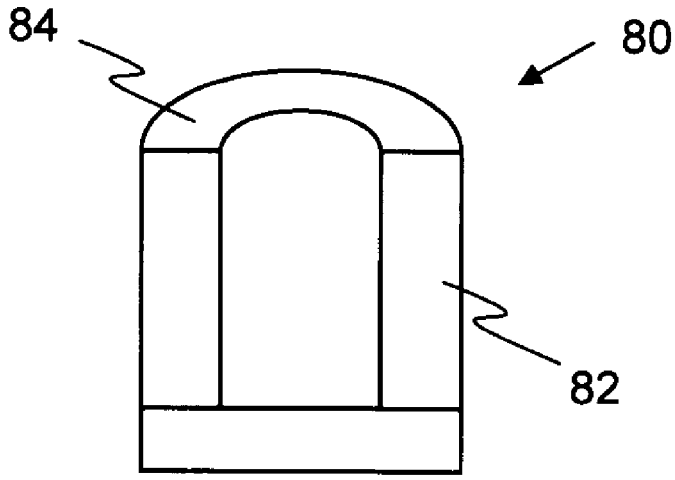
FIG. 13 is a diagrammatic view of an embodiment of a structure formed from embodiments of blast energy mitigating composites.

Blast energy mitigating composites may be placed or secured on or near surfaces that are desirous of being protected from blast energy. FIG. 12 illustrates a blast energy mitigating composite in the form of a panel 70 on a surface 72 to be protected. Rooms, boxes, vehicles, boats, airplanes, trains, cars, are just a few of the many examples of items having surfaces for placing a blast energy mitigating composite. One or more blast energy mitigating composites may be assembled to form a blast energy mitigating structure. With reference to FIG. 13, a blast energy mitigating domed structure 80 is illustrated in cross-section. The structure 80 includes a first blast energy mitigating composite 82 and a second blast energy mitigating composite 84. Structures such as boxes, cases, rooms, cylinders or annulus, may be constructed from one or more blast energy mitigating composites.

The blast energy mitigating composite may be prepared by a variety of methods, including, but not limited to molding, vacuum assisted resin transfer techniques, and other composite forming techniques known to those skilled in the art. Generally, a mold for the composite is prepared according to the desired shape and dimensions of the desired blast energy mitigating composite. An amount of the matrix material to form the energy mitigating matrix is placed in the mold. A layer of energy mitigating units is positioned on the matrix material followed by another layer of matrix material. These steps are repeated until the desired number of layers of energy mitigating units are reached or until the desired dimensions of the composite is reached. The matrix material is allowed cure, post-cure, heat treat, cross-link, set, solidify, or the like to form the desired energy mitigating matrix.

EXAMPLES

Blast Energy Mitigating Composite A

A rectangular, 2 inch thick, blast energy mitigating composite panel was tested to determine its ability to absorb blast energy. This panel was comprised of three rectangular carbon foam sub-panels. Two of the three sub-panels were comprised of CFOAM 17 (Touchstone Research Laboratory, Ltd., Triadelphia W. Va.). The remaining sub-panel was comprised of CFOAM 25 (Touchstone Research Laboratory, Ltd.). The orientation of the sub-panels in the blast energy mitigating composite from front to back was a CFOAM 17 sub-panel, followed by the other CFOAM 17 sub-panel, followed by the CFOAM 25 sub-panel. The three carbon foam sub-panels were encapsulated in a matrix of polyurethane to provide the blast energy mitigating composite panel.

The carbon foam sub-panels of the blast energy mitigating composite panel were of essentially equivalent size with a thickness of ⅝ inch. Each of the sub-panels had a series of intersecting groves defining a cross-hatch pattern on both of the sub-panel major faces and extending to the limits of those faces. These groves were approximately ½ inch deep with a ⅛ inch grove width. For each sub-panel, groves were orientated parallel to the x axis of one of the sub-panel major faces with a spacing of ¾ inch along the y axis. On the same sub-panel major face, approximately ½ inch deep and ⅛ inch wide groves orientated parallel to the y axis were spaced at ¾ inch intervals along the x axis. For a given sub-panel, the grove pattern on opposite major faces were off-set by ⅜ inch along both the x and y axis.

Testing of the blast energy mitigating composite panel was conducted by first contacting the back of the composite panel with a 0.375 inch thick steel "witness" plate. This steel "witness" plate was fixed to a rigid support such that it covered a 2 inch diameter hole in the rigid support and that the blast energy mitigating composite panel was approximately centered over the hole. Once the witness plate and energy mitigating composite panel were in place, a 5 pound charge of C4 explosive was detonated 9 inches from the front of the blast energy mitigating composite panel. Instrumentation connected to the "witness" plate, through the 2 inch diameter hole in the rigid support, provided measurement of the strain transmitted to the rigid support through the witness plate. It was determined that the blast energy mitigating composite panel absorbed 83% of the blast energy transported by the shock waves contacting the blast energy mitigating composite panel in the "open space" test environment.

Blast Energy Mitigating Composite B

Another blast energy mitigating composite B was constructed similar to blast energy mitigating composite panel A except that the matrix was constructed from epoxy. The testing parameters were the same. The blast energy mitigating composite B absorbed about 70% of the blast energy transported by the shock waves contacting the blast energy mitigating composite panel in the open space test environment.

What is claimed is:

1. A blast energy mitigating composite, comprising:

at least one grooved panel comprising a porous energy mitigating material, wherein grooves are positioned in the energy mitigating material and wherein the grooves positioned in the energy mitigating material define a plurality of energy mitigating units; and a polymeric energy mitigating matrix surrounding the at least one grooved panel, wherein the polymeric energy mitigating matrix exhibits an elongation greater than about 100% by ASTM D638.

2. The blast energy mitigating composite of claim 1, wherein the porous energy mitigating material exhibits relatively uniform pores sizes, and wherein said pore sizes may range from about 50 μm to about 2 mm.

3. The blast energy mitigating composite of claim 1, wherein the porous energy mitigating material, when subjected to a compressive strength test exhibits at least as much energy absorption in the secondary energy mitigation region as was absorbed in the initial energy mitigation region.

4. The blast energy mitigating composite of claim 3, wherein the porous energy mitigating material absorbs about 150% to about 300% more energy in the secondary energy mitigation region that in the initial energy mitigation region.

5. The blast energy mitigating composite of claim 1, wherein the porous energy mitigating material has a compressive strength ranging from about 300 p.s.i. to about 18,000 p.s.i.

6. The blast energy mitigating composite of claim 1, wherein the porous energy mitigating material is a carbon foam or a polymer foam.

7. The blast energy mitigating composite of claim 1, wherein the porous energy mitigating material is a carbon foam having a density ranging from about 0.1 g/cc to about 1.0 g/cc.

8. The blast energy mitigating composite of claim 1, wherein the energy mitigating units have a surface coating on at least one surface of the energy mitigating units.

9. The blast energy mitigating composite of claim 8, wherein the surface coating comprises a layer of textile material.

10. The blast energy mitigating composite of claim 1, wherein the energy mitigating units have a cross-sectional shape of triangular, circular, oval, cross-shaped, rectangular, pentagonal, hexagonal, heptagonal, or octagonal.

11. The blast energy mitigating composite of claim 1, wherein the energy mitigating units have a size ranging from about ¼ of an inch to about 2 inches.

12. The blast energy mitigating composite of claim 1, wherein the energy mitigating matrix comprises a matrix material that has a different blast wave impedance value than the energy mitigating material.

13. The blast energy mitigating composite of claim 12, wherein the matrix material is semi-rigid polyurethane, polyurethane, polyethylene, polypropylene, resins, silicone, nylon, latex, or rubber.

14. The blast energy mitigating composite of claim 12, wherein the matrix material is epoxy, acrylics, polycarbonates, phenolic resins, or furfural resins.

15. The blast energy mitigating composite of claim 1, wherein the grooves have a depth ranging from about ¼ about ¾ of the thickness of the panel.

16. The blast energy mitigating composite of claim 1, further comprising at least two panels.

17. The blast energy mitigating composite of claim 1, further comprising at least two panels, wherein energy mitigating units in each panel are staggered relative to energy mitigating units in adjacent panels, wherein the energy mitigating units have a size ranging from about ¼ of an inch to about 2 inches, and wherein the porous energy mitigating material is a carbon foam having a density ranging from about 0.1 g/cc to about 1.0 g/cc.

18. The blast energy mitigating composite of claim 1, wherein the matrix material is semi-rigid polyurethane.

19. A blast energy mitigating structure, comprising:

at least one blast energy mitigating composite, wherein the at least one blast energy mitigating composite comprises a porous energy mitigating material having a plurality of grooves positioned in the porous energy mitigating material and wherein the plurality of grooves define a plurality of energy mitigating units contained in a polymeric energy mitigating matrix exhibiting an elongation greater than about 100% by ASTM D638.

* * * * *